US010526928B2

(12) United States Patent
Wetzel et al.

(10) Patent No.: US 10,526,928 B2
(45) Date of Patent: Jan. 7, 2020

(54) AXIAL CAM SHIFTING VALVE ASSEMBLY WITH ADDITIONAL DISCRETE VALVE EVENT

(71) Applicant: Eaton Corporation, Cleveland, OH (US)

(72) Inventors: Philip William Wetzel, Battle Creek, MI (US); Douglas J. Nielsen, Marshall, MI (US); James E. McCarthy, Jr., Kalamazoo, MI (US)

(73) Assignee: Eaton Corporation, Cleveland, OH (US)

( * ) Notice: Subject to any disclaimer, the term of this patent is extended or adjusted under 35 U.S.C. 154(b) by 78 days.

(21) Appl. No.: 15/661,450

(22) Filed: Jul. 27, 2017

(65) Prior Publication Data

US 2017/0321575 A1 Nov. 9, 2017

Related U.S. Application Data

(63) Continuation of application No. PCT/US2016/014902, filed on Jan. 26, 2016.

(Continued)

(51) Int. Cl.

*F01L 1/14* (2006.01)
*F01L 1/24* (2006.01)

(Continued)

(52) U.S. Cl.

CPC ..... *F01L 1/24* (2013.01); *F01L 1/047* (2013.01); *F01L 1/18* (2013.01); *F01L 9/04* (2013.01);

(Continued)

(58) Field of Classification Search

CPC ..... F01L 1/24; F01L 1/18; F01L 1/047; F01L 1/2405; F01L 1/185; F01L 13/0005;

(Continued)

(56) References Cited

U.S. PATENT DOCUMENTS 6,321,704 B1 11/2001 Church et al.
7,219,634 B2 * 5/2007 Hitomi ..... F01L 1/185 123/295

(Continued)

FOREIGN PATENT DOCUMENTS

CN 1756896 A 4/2006
CN 1975117 A 6/2007

(Continued)

OTHER PUBLICATIONS

International Search Report and Written Opinion for International Application No. PCT/US2016/014902 dated May 12, 2016, 18 pages.

(Continued)

*Primary Examiner* — Zelalem Eshete

(74) *Attorney, Agent, or Firm* — RMCK Law Group PLC

(57) ABSTRACT

A valve train assembly includes a rocker arm assembly, and axial shifting cam assembly, and a lost motion device. The axial shifting cam assembly is movable between a first axial position and a second axial position on a camshaft, the cam assembly having a first cam having a first lobe, and a second cam having a second lobe. The first and second lobes are configured to each selectively engage the rocker arm assembly to respectively perform a first and a second discrete valve lift event. The lost motion device is operably associated with the rocker arm assembly and configured to perform a third discrete valve lift event, distinct from the first and second valve lift events.

1 Claim, 5 Drawing Sheets

Related U.S. Application Data

(60) Provisional application No. 62/109,021, filed on Jan. 28, 2015.

(51) Int. Cl.
*F01L 1/047* (2006.01)
*F01L 13/00* (2006.01)
*F01L 1/18* (2006.01)
*F01L 9/04* (2006.01)

(52) U.S. Cl.
CPC ... *F01L 13/0005* (2013.01); *F01L 2001/0473* (2013.01); *F01L 2013/001* (2013.01)

(58) Field of Classification Search
CPC ... F01L 13/0036; F01L 9/04; F01L 2013/001; F01L 2013/0052; F01L 2105/00; F01L 2001/0473
See application file for complete search history.

(56) References Cited

U.S. PATENT DOCUMENTS

| | | | | |
|---|---|---|---|---|
| 8,474,425 | B2 | 7/2013 | Kirbach | |
| 2003/0172889 | A1 | 9/2003 | Djordjevic | |
| 2005/0092273 | A1 | 5/2005 | Cecur et al. | |
| 2007/0034184 | A1* | 2/2007 | Dengler | F01L 1/08 123/90.17 |
| 2007/0113813 | A1* | 5/2007 | Lalone | F01L 1/185 123/90.44 |
| 2007/0204818 | A1* | 9/2007 | Dingle | F01L 1/181 123/90.16 |
| 2011/0048352 | A1 | 3/2011 | Hendriksma | |
| 2011/0061615 | A1 | 3/2011 | Hendriksma | |
| 2012/0067312 | A1 | 3/2012 | Lee | |
| 2015/0167507 | A1 | 6/2015 | Boot et al. | |

FOREIGN PATENT DOCUMENTS

| | | | |
|---|---|---|---|
| DE | 10055014 | A1 | 5/2002 |
| DE | 102006011981 | A1 | 9/2007 |
| DE | 102007051739 | A1 | 5/2009 |
| EP | 0908605 | A2 | 4/1999 |
| GB | 2206380 | A | 1/1989 |
| JP | 2013083202 | A | 5/2013 |
| JP | 2014152642 | A | 8/2014 |

OTHER PUBLICATIONS

European Search Report for EP Application No. 16743954.6 dated Aug. 31, 2018, 6 pages.
Chinese Office Action for CN Application No. 201680007654.4 dated Apr. 8, 2019.

* cited by examiner

AXIAL CAM SHIFTING VALVE ASSEMBLY WITH ADDITIONAL DISCRETE VALVE EVENT

CROSS-REFERENCE TO RELATED APPLICATIONS

This application is a continuation of International Application No. PCT/US2016/014902 filed Jan. 26, 2016, which claims priority to U.S. Provisional Application No. 62/109,021 filed on Jan. 28, 2015, which is incorporated by reference in its entirety as if set forth herein.

FIELD

The present disclosure relates generally to an axial cam shifting valve assembly and, more particularly, to an axial cam shifting valve assembly utilizing a lash adjuster or rocker arm assembly to provide an additional discrete valve event.

BACKGROUND

Recent automotive and truck industry trends have placed increased importance on the reduction of fuel consumption and emissions of the internal combustion engine. One method of reducing fuel consumption is to optimize air intake and exhaust into the cylinders through incorporation of discrete valve profiles. Current axial cam shifting systems are limited to two discrete positions and thus two discrete valve lift profiles offering two valve lift functions. A two position system allows a simple actuation system that only needs to translate the axial shifting components to either a front or a rear position. Mechanical stops can be designed into the system to stop the components in the correct positions for positive axial location. While the current systems are satisfactory for their intended purpose it is desirable to provide more than two discrete valve lift profiles to further optimize the valve system for a given application and operating condition.

SUMMARY

In one aspect of the present disclosure, a valve train assembly is provided. The valve train assembly includes a rocker arm assembly, an axial shifting cam assembly movable between a first axial position and a second axial position on a camshaft, the cam assembly having a first cam having a first lobe, and a second cam having a second lobe, the first and second lobes configured to each selectively engage the rocker arm assembly to respectively perform a first and a second discrete valve lift event, and a lost motion device operably associated with the rocker arm assembly and configured to perform a third discrete valve lift event, distinct from the first and second valve lift events.

In addition to the foregoing, the rocker arm assembly may include one or more of the following features: wherein the cam assembly further includes a third cam having a third lobe configured to selectively engage the rocker arm assembly to perform a fourth discrete valve lift event distinct from the first, second, and third valve lift events; wherein the rocker arm assembly includes a body having a first end and a second end, the first end configured to couple to a cylinder valve, and the second end configured to couple to a lash adjuster; wherein the rocker arm assembly includes a roller configured to be engaged by the first and second lobes; a lash adjuster coupled to the rocker arm assembly, the lash adjuster including the lost motion device; wherein the lash adjuster further includes a hydraulic lash adjuster assembly; wherein the lash adjuster includes a cylinder deactivation assembly having the lost motion device, the cylinder deactivation assembly movable between an activated position where the lost motion device does not absorb a force exerted by the cam assembly, and a deactivated position where the lost motion device at least partially absorbs the force exerted by the cam assembly; wherein the cylinder deactivation assembly is electrically actuated; wherein the cylinder deactivation assembly further includes a latching device configured to selectively engage a housing of the lash adjuster when the cylinder deactivation assembly is in the activated position; wherein the latching device includes a biasing mechanism and at least one pin, the biasing mechanism biasing the at least one pin radially outward into the activated position; wherein the lash adjuster housing includes a latching aperture configured to receive the at least one pin when the cylinder deactivation assembly is in the activated position, the lashing aperture configured to receive a flow of pressurized hydraulic fluid to move the at least one pin radially inward into the deactivated position; and wherein the lost motion device is disposed within a housing of the lash adjuster, the lost motion device comprising a tubular body, a first spring disposed about the tubular body, and a second spring disposed about the first spring and the tubular body, wherein the lost motion device is collapsible to absorb a force exerted by the cam assembly.

In another aspect of the present disclosure, an internal combustion engine is disclosed. The internal combustion engine includes a lash adjuster mounted to an engine block, an engine valve configured to selectively open and close an exhaust or intake passage, and a rocker arm assembly coupled to the lash adjuster at a first end and engaged with the engine valve at a second end opposite the first end. The engine further includes an axial shifting cam assembly movable between a first axial position and a second axial position on a camshaft, the cam assembly having a first cam having a first lobe, and a second cam having a second lobe, the first and second lobes configured to each selectively engage the rocker arm assembly to respectively perform a first and a second discrete valve lift event, and a lost motion device operably associated with the rocker arm assembly and configured to perform a third discrete valve lift event, distinct from the first and second valve lift events.

In addition to the foregoing, the rocker arm assembly may include one or more of the following features: wherein the rocker arm assembly includes a roller configured to be engaged by the first and second lobes; wherein the lost motion device is disposed within the lash adjuster; wherein the lash adjuster further includes a hydraulic lash adjuster assembly; wherein the lash adjuster includes a cylinder deactivation assembly having the lost motion device, the cylinder deactivation assembly movable between an activated position where the lost motion device does not absorb a force exerted by the cam assembly, and a deactivated position where the lost motion device at least partially absorbs the force exerted by the cam assembly; wherein the cylinder deactivation assembly further includes a latching device configured to selectively engage a housing of the lash adjuster when the cylinder deactivation assembly is in the activated position; wherein the latching device includes a biasing mechanism and at least one pin, the biasing mechanism biasing the at least one pin radially outward into the activated position; wherein the lash adjuster housing includes a latching aperture configured to receive the at least one pin when the cylinder deactivation assembly is in the activated position, the lashing aperture configured to receive a flow of pressurized hydraulic fluid to move the at least one pin radially inward into the deactivated position; wherein the lost motion device is disposed within a housing of the lash adjuster, the lost motion device comprising a tubular body, a first spring disposed about the tubular body, and a second spring disposed about the first spring and the tubular body, wherein the lost motion device is collapsible to absorb a force exerted by the cam assembly; wherein the engine valve is opened during the first and second discrete valve lift events, and the valve is closed during the third discrete valve lift event, the third discrete valve lift event being a lost motion type valve event; and wherein the cam assembly further includes a third cam having a third lob configured to selectively engage the rocker arm assembly to perform a fourth discrete valve lift event distinct from the first, second, and third valve lift events.

In another aspect of the present disclosure, a valve train assembly is disclosed. The valve train assembly includes a rocker arm assembly, and an axial shifting cam assembly movable between a first axial position and a second axial position on a camshaft, the cam assembly having a first cam having a first lobe, and a second cam having a second lobe, the first and second lobes configured to each selectively engage the rocker arm assembly to respectively perform a first and a second discrete valve lift event. The rocker arm assembly is configured to perform a third discrete valve lift event, distinct from the first and second valve lift events.

In addition to the foregoing, the rocker arm assembly may include one or more of the following features: wherein the cam assembly further includes a third cam having a third lobe configured to selectively engage the rocker arm assembly to perform a fourth discrete valve lift event distinct from the first, second, and third valve lift events, wherein the rocker arm assembly is a deactivating rocker arm assembly that allows for selective activation and deactivation of the rocker arm assembly, at least one of the activation and deactivation providing the third discrete valve event, wherein the rocker arm assembly is a dual lift rocker arm assembly configured for selective movement between a first mode and a second mode, at least one of the first and second modes providing the third discrete valve event, wherein the rocker arm assembly is a dual lift rocker arm assembly configured for selective movement between a first mode and a second mode, at least one of the first and second modes providing the third discrete valve event; and wherein the dual lift rocker arm assembly is moved between the first and second modes hydraulically and/or electrically.

In another aspect of the present disclosure, an internal combustion engine is disclosed. The engine includes an engine valve configured to selectively open and close an exhaust or intake passage, a rocker arm assembly engaged with the engine valve at a first end, and an axial shifting cam assembly movable between a first axial position and a second axial position on a camshaft, the cam assembly having a first cam having a first lobe, and a second cam having a second lobe, the first and second lobes configured to each selectively engage the rocker arm assembly to respectively perform a first and a second discrete valve lift event. The rocker arm assembly is configured to perform a third discrete valve lift event, distinct from the first and second valve lift events.

In addition to the foregoing, the rocker arm assembly may include one or more of the following features: wherein the cam assembly further includes a third cam having a third lobe configured to selectively engage the rocker arm assembly to perform a fourth discrete valve lift event distinct from the first, second, and third valve lift events; wherein the rocker arm assembly is a deactivating rocker arm assembly that allows for selective activation and deactivation of the rocker arm assembly, at least one of the activation and deactivation providing the third discrete valve event; wherein the rocker arm assembly is a dual lift rocker arm assembly configured for selective movement between a first mode and a second mode, at least one of the first and second modes providing the third discrete valve event; and wherein the rocker arm assembly is a dual lift rocker arm assembly configured for selective movement between a first mode and a second mode, at least one of the first and second modes providing the third discrete valve event.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

It will be appreciated that the illustrated boundaries of elements in the drawings represent only one example of the boundaries. One of ordinary skill in the art will appreciate that a single element may be designed as multiple elements or that multiple elements may be designed as a single element. An element shown as an internal feature may be implemented as an external feature and vice versa.

Further, in the accompanying drawings and description that follow, like parts are indicated throughout the drawings and description with the same reference numerals, respectively. The figures may not be drawn to scale and the proportions of certain parts have been exaggerated for convenience of illustration.

DETAILED DESCRIPTION

Figure 1:
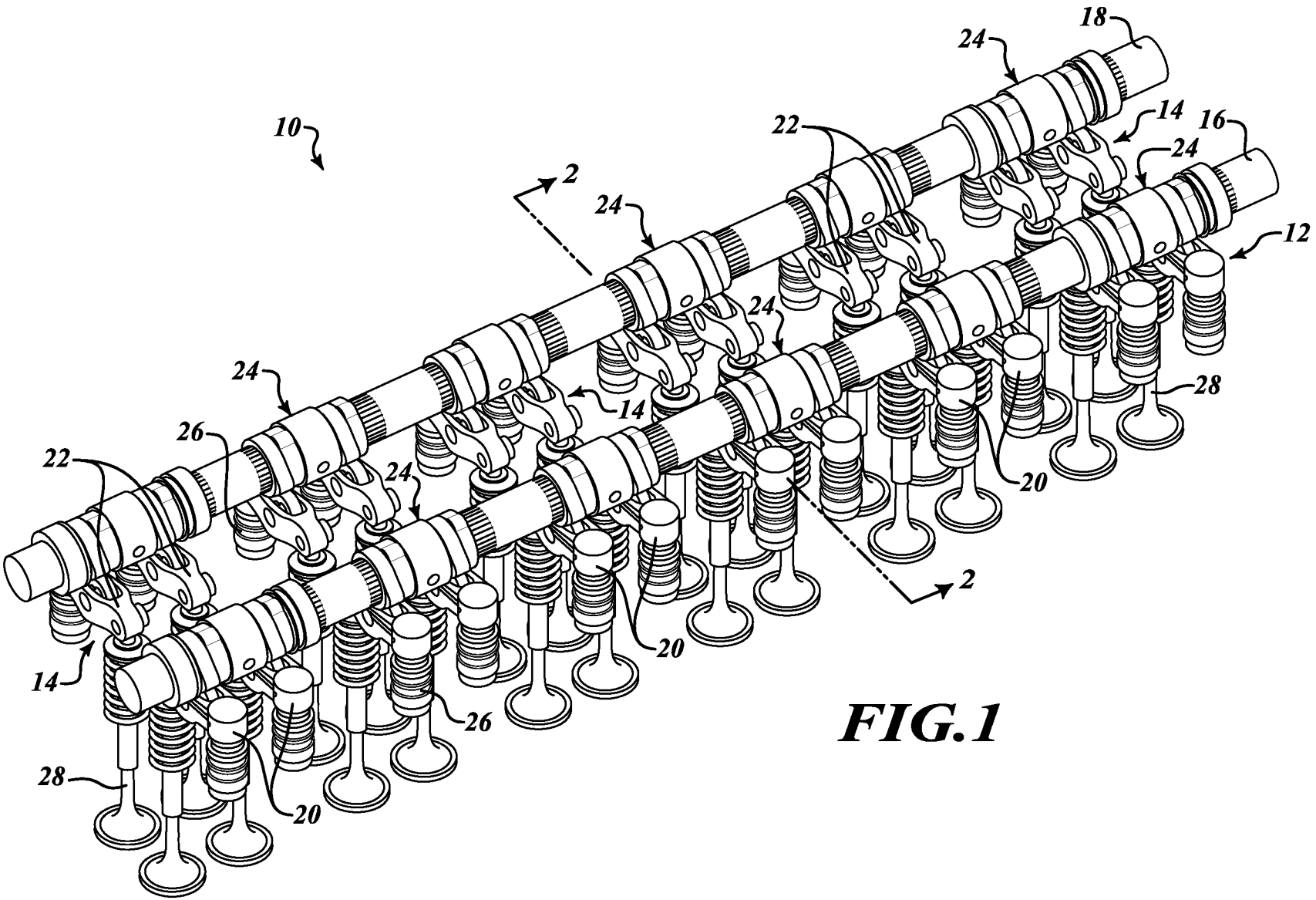
FIG. 1 is a perspective view of a valve train assembly incorporating a series of rocker arm assemblies constructed in accordance with one example of the present disclosure.
Figure 3:
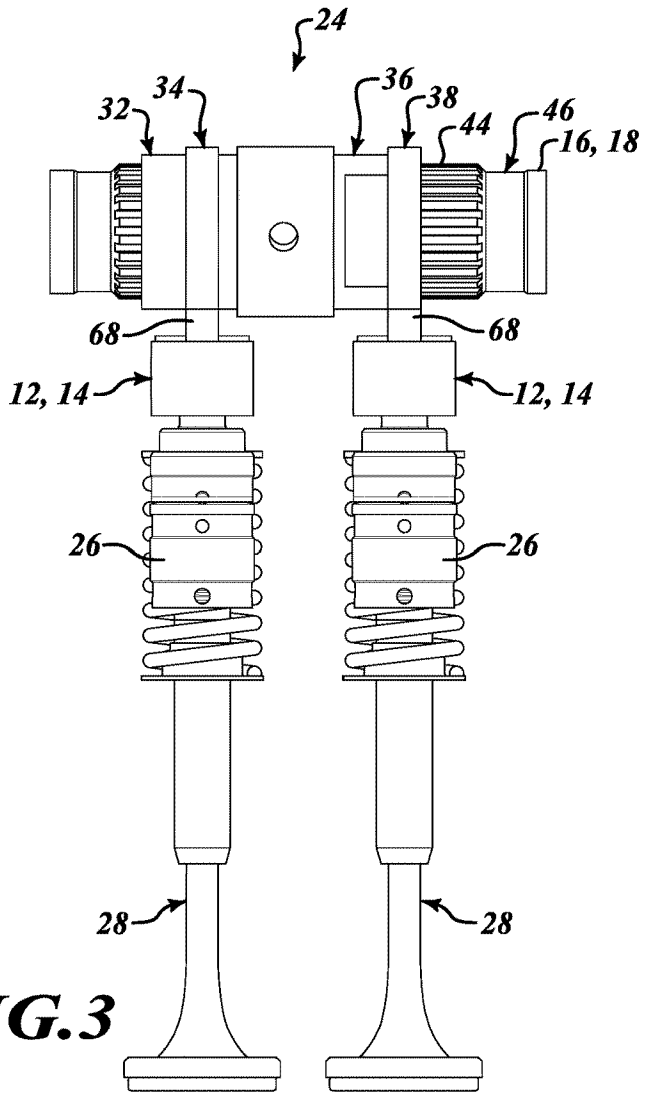
FIG. 3 is a side view of a portion of the valve train assembly shown in FIG. 1.
Figure 2:
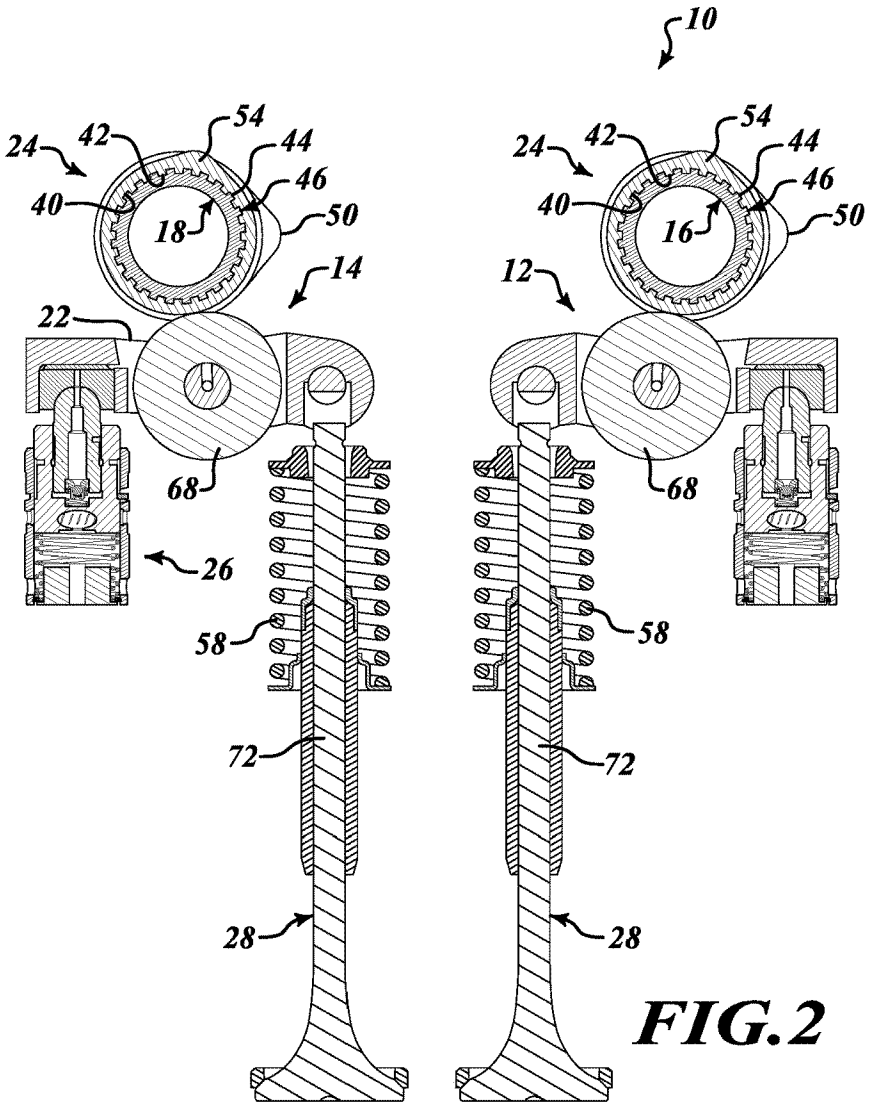
FIG. 2 is a cross-sectional view of the valve train assembly shown in FIG. 1 and taken along line 3-3.

With initial reference to FIGS. 1-3, a valve train assembly constructed in accordance with one example of the present disclosure is shown and generally identified at reference 10. The valve train assembly 10 shown can be configured for use in a six-cylinder engine. However, it will be appreciated that the present teachings are not so limited. In this regard, the present disclosure may be used in any valve train assembly. The valve train assembly 10 can include a series of intake rocker arm valve assemblies 12 and a series of exhaust rocker arm valve assemblies 14. An intake camshaft 16 can be operably associated with the intake rocker arm valve assemblies 12, and an exhaust camshaft 18 can be operably associated with the exhaust rocker arm valve assemblies 14. The camshafts 16, 18 can rotate, for example, based on a rotatable input from a timing chain or belt linkage connected to a crankshaft of the engine (not shown).

The rocker arm assemblies 12, 14 may respectively include rocker arms 20, 22 configured for operation with a lobed cam assembly 24, a lash adjuster 26, and an engine cylinder valve 28 for an internal combustion engine cylinder (not shown).

The cam assembly 24 can be arranged on camshaft 16 or 18 and is configured to selectively engage one of rocker arm assemblies 12, 14. The cam assembly 24 can be configured for an axial cam shifting operation where the cam assembly 24 can be moved axially along the camshaft 16, 18 between at least two discrete positions. As described herein, axial movement of the cam assembly 24 can control the opening height and/or timing of the cylinder valve 28 depending upon the axial position of the cam assembly 24.

Figure 4:
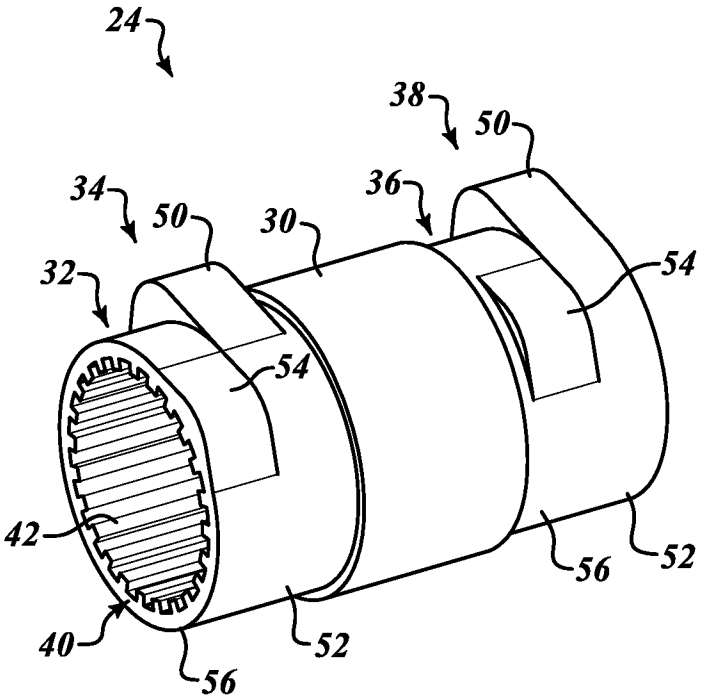
FIG. 4 is a perspective view of a cam assembly shown in FIG. 1 constructed in accordance with one example of the present disclosure.

With additional reference to FIG. 4, each cam assembly 24 can include a body 30, a first cam 32, a second cam 34, a third cam 36, and a fourth cam 38. The body 30 can be tubular and include in inner diameter or inner surface 40, which can be configured to receive the rotatable camshaft 16, 18. For example, as illustrated in FIG. 2, the inner surface 40 may include a plurality of teeth 42 configured to meshingly engage teeth 44 formed on an outer surface 46 of the camshaft 16, 18.

As shown in FIG. 4, the first and third cams 32, 34 can have a first lobe or lift profile 50 and a base circle 52, and the second and fourth cams 34, 38 can have a second lobe or lift profile 54 and a base circle 56. In the illustrated example, the first lift profiles 50 are angularly aligned and offset from the second lift profiles 54, which are similarly angularly aligned. Although each cam is illustrated as having a single lobe, each cam may have any suitable number of additional lobes to achieve separate or similar valve lift events.

The first lift profile 50 is configured to engage the rocker arm valve 20, 22 when the cam assembly 24 is in a first axial position, thereby achieving a first discrete valve lift event (e.g., a normal engine combustion mode, an engine brake mode, a deactivated cylinder mode, etc.). The second lift profile 54 is configured to engage the rocker arm valve 20, 22 when the cam assembly 24 is in a second axial position, thereby achieving a second discrete valve lift event that can be distinct from the first valve lift event. Moreover, the valve assemblies 12, 14 can achieve a third discrete valve event utilizing the lash adjuster 26, as is described herein in more detail. Accordingly, the combination of the axial cam shifting (providing the first and second discrete valve profiles) and the lash adjuster 26 (providing the third discrete valve profile) can provide an efficient valve train assembly 10 capable of providing three distinct valve profiles.

Figure 5:
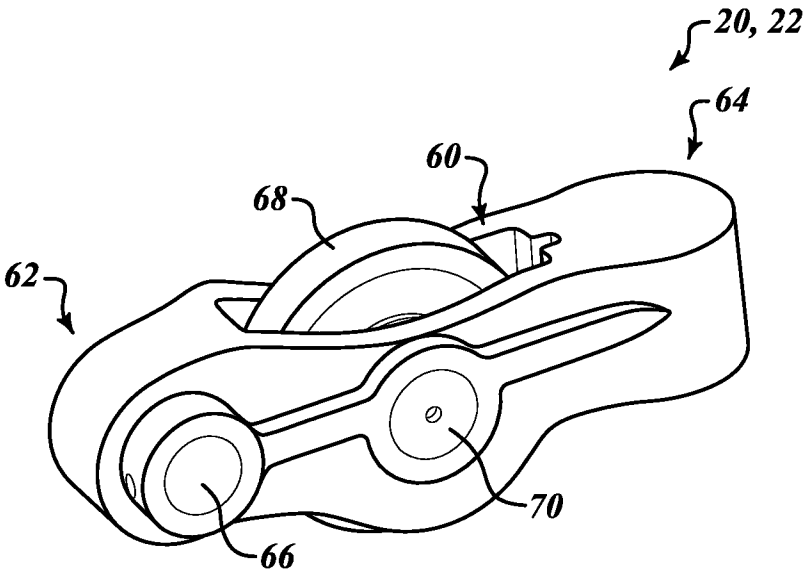
FIG. 5 is a perspective view of a rocker arm shown in FIG. 1 constructed in accordance with one example of the present disclosure.

With reference to FIGS. 4 and 5, rocker arm 20, 22 is configured to be engaged by the cam assembly 24 and can generally include a body 60 having a first end 62 and a second end 64. The body 60 can be pivotally mounted on a shaft or pivot axle 66, and the body 60 can include a cam interfacing component such as a roller 68 rotatably mounted on an axle 70. The roller 68 is configured to be selectively engaged by lift profiles 50, 54 as the cam assembly 24 is rotated and axially shifted. The body first end 62 engages a stem 72 of the valve 28, and the body second end 64 is mounted for pivotal movement on the lash adjuster 26, which is supported in an engine block (not shown). The lash adjuster 26 may be, for example, a hydraulic lash adjuster, which is used to accommodate lash between components in the valve train assembly 10.

Figure 7:
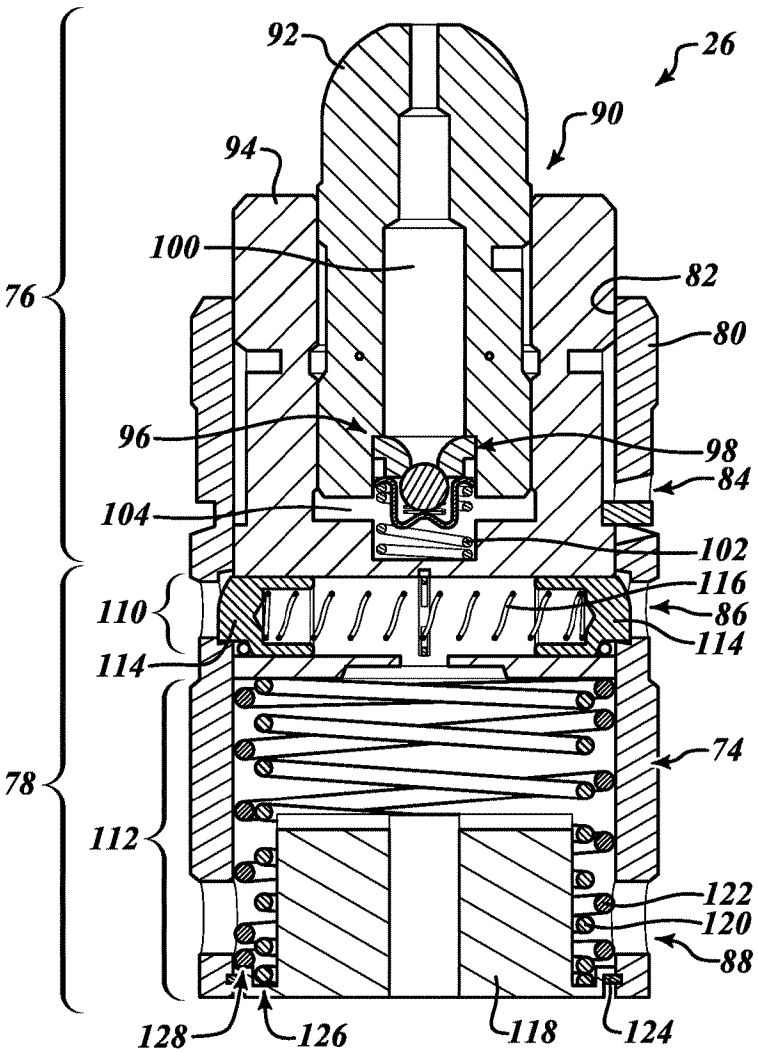
FIG. 7 is a cross-sectional view of the lash adjuster shown in FIG. 6 and taken along line 7-7.
Figure 6:
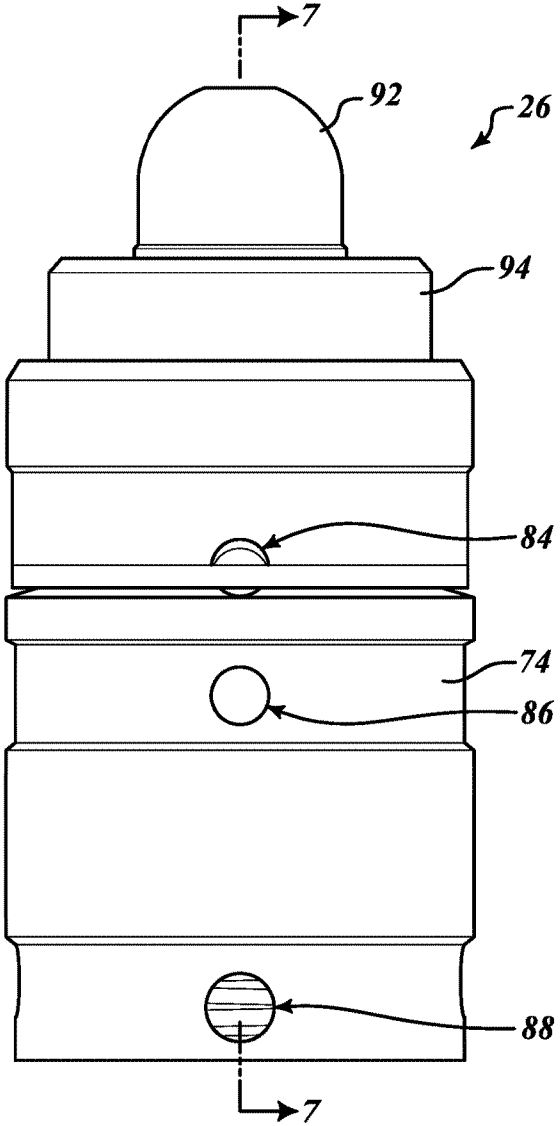
FIG. 6 is a side view of a lash adjuster shown in FIG. 1 constructed in accordance with one example of the present disclosure.

In the example implementation shown in FIGS. 6 and 7, the lash adjuster 26 generally includes a housing 74, a hydraulic lash adjuster (HLA) assembly 76, and a cylinder deactivation assembly 78. The cylinder deactivation assembly 78 includes an integrated lost motion function and is configured to provide the third discrete valve profile by selectively operating in a deactivated condition.

In the example implementation, the lash adjuster 26 can be selectively deactivated to introduce sufficient lost motion into the valve train 10 such that cyclical motion of the cam assembly 24 does not result in any corresponding opening and closing movement of the valve 28 for that particular cylinder. Accordingly, in this deactivated condition, the engine valve 28 remains closed under the influence of a valve closing spring 58 (see FIG. 2).

The lash adjuster housing 74 generally includes a tubular wall 80 defining an inner bore 82 configured to at least partially receive the HLA assembly 76 and the cylinder deactivation assembly 78. A port 84 can be formed through the wall 80 to receive a constant supply a hydraulic fluid (e.g., oil) from a first oil feed (not shown), which supplies the oil to the HLA assembly 76. A latching aperture 86 can be formed through the wall 80 to selectively receive a portion of the cylinder deactivation assembly 78 to move the assembly 78 from an activated position to the deactivated position. The latching aperture 86 is configured to receive a supply of hydraulic fluid form a second oil feed (not shown), which supplies oil to the cylinder deactivation assembly 78. An oil drain or ventilation opening 88 can be formed through the wall 80 and is configured to prevent pressure buildup, which could impede the deactivation of the lash adjuster 26.

The HLA assembly 76 is configured to take up any lash between the HLA assembly 76 and the rocker arm 20, 22. In one exemplary implementation, the HLA assembly 76 can comprises a plunger assembly 90 including an inner plunger body 92 disposed within an outer plunger body 94. The plunger assembly 90 is disposed within the housing bore 82, and the inner plunger body 92 can define a valve seat 96 to receive a check ball assembly 98, which is positioned between the inner plunger body 92 and the outer plunger body 94.

The check ball assembly 98 can be configured to hold oil within a chamber 100 between the inner and outer plunger bodies 92, 94. A biasing mechanism 102 (e.g., a spring) can bias the inner plunger body 92 upward to expand the plunger assembly 90 and take up any lash. The inner plunger body 92 can include a chamber 104 configured to receive hydraulic fluid from the port 84. As the inner plunger body 92 is biased upward, oil is drawn from the chamber 104 and through check ball assembly 98 to the chamber 100 defined between plunger bodies 92, 94.

The cylinder deactivation assembly 78 is configured to selectively transition the lash adjuster 26 between the activated condition, where the cam assembly 24 causes movement of the rocker arm 20, 22 to open the valve 28, and the deactivated condition, where the assembly 78 collapses to absorb the movement of the rocker arm 20, 22 such that the valve 28 does not open. In the illustrated embodiment, cylinder deactivation assembly 78 is hydraulically actuated. However, in other examples, cylinder deactivation assembly 78 may be electrically actuated.

The cylinder deactivation assembly 78 generally includes a latching device 108 and a lost motion device 110. The latching device 108 is disposed within a radially extending channel 112 formed in the outer plunger body 94 and can include one or more pins 114 and a biasing mechanism 116 (e.g. a spring). The pins 114 are arranged within the channel 112 and are urged radially outward by the biasing mechanism 116 into the activated position (FIG. 7), such that the pins 114 extend through the latching apertures 86. In this activated position, the plunger assembly 90 can be prevented from downward movement against the lost motion device 110.

The pins 114 are moved into the deactivated position (not shown) by a supply of hydraulic fluid through aperture 86. The supply of fluid urges the pins 114 radially inward over the force of the biasing mechanism 116 such that the pins 114 are retracted and released from the latching apertures 86. In this deactivated position, the plunger assembly 90 can be moved downwardly against the lost motion device 110 to absorb motion of the rocker arm 20, 22 and provide the third discrete valve profile. In an alternative implementation, electric latching may be utilized instead of hydraulic pressure control of the latching device 108.

The lost motion device 110 can generally include a tubular body 118, a first biasing mechanism 120 (e.g., a spring), and a second biasing mechanism 122 (e.g., a spring). The tubular body 118 can be prevented from downward movement by a clip 124 disposed at least partially within wall 80. The first biasing mechanism 120 can be disposed about body 118, and the second biasing mechanism 122 can be disposed about the first biasing mechanism 120 and the body 118. The tubular body 118 can include a first shoulder 126 configured to seat a portion of the first biasing mechanism 120, and a second shoulder 128 configured to seat a portion of the second biasing mechanism 122. The opposite ends of biasing mechanisms 120, 122 are seated against a bottom of the outer plunger body 94.

In this way, the biasing mechanisms 120, 122 are disposed between the plunger assembly 90 and the tubular body 118 and are configured to receive and absorb downward movement of the plunger assembly 90 when the pins 114 are in the retracted position. As such, the lost motion device 110 is free to collapse and perform a lost motion type event until hydraulic fluid pressure is turned off and the latch pins 114 extend radially outward into the latching apertures 86.

In operation, the valve train assembly 10 is configured to operate in three discrete valve event positions. During operation in the first discrete position, the cylinder deactivation assembly 78 can be in the activated position (preventing lost motion), and the cam assembly 24 can be in the first axial position where the first lift profile 50 is configured to engage the roller 68 of the rocker arm 20, 22. As the camshaft 16, 18 rotates, the first lobe 50 engages the roller 68 and exerts a force that causes rocker arm body 60 to pivot about the lash adjuster 26 and open the valve 28. As the first lobe 50 passes out of engagement with the roller 68, the valve 28 is closed. When the base circle 52 engages the roller 68, the valve 28 is fully closed and the first discrete lift event is complete.

During operation in the second discrete position, the cylinder deactivation assembly 78 remains activated, and the cam assembly 24 can be shifted to the second axial position where the second lift profile 54 is configured to engage the roller 68. As the camshaft 16, 18 continues to rotate, the second lobe 54 engages the roller 68 and exerts a force that causes the rocker arm body 60 to pivot about the lash adjuster 26 and open the valve 28 an amount different than the first lift event. As the second lobe 54 passes out of engagement with the roller 68, the valve 28 is closed. When the base circle 56 engages the roller 68, the valve 28 is fully closed and the second discrete lift event is complete.

During operation in the third discrete position, the cam assembly 24 can be in the first or second axial positions. The cylinder deactivation assembly 78 can be subsequently moved to the deactivated position by supplying hydraulic fluid to aperture 86, thereby retracting the pins 114. As the camshaft 16, 18 rotates, the lift profile 50 or 54 engages the roller 68 and exerts a force on the rocker arm body 60. However, because the cylinder deactivation assembly 78 is in the deactivated position (pins 114 retracted), the body 60 pivots about the pivot axle 66 and the force is transmitted to the plunger assembly 90, which moves downwardly against the lost motion mechanisms 120, 122. Accordingly, the body 60 does not rotate about the lash adjuster 26 or open the valve 28.

In the deactivated position, the force from the cam assembly 24 is transferred to the cylinder deactivation assembly 78 due to the resistance force of biasing mechanisms 120, 122 being less than the resistance force of the valve closing spring 58. Accordingly, the deactivation assembly 78 absorbs the movement of the rocker arm 20, 22 and the valve 28 is not opened, thereby providing a discrete, deactivated third lift event. In other implementations, the cam assembly 24 may include additional cams and/or lift profiles to provide additional discrete lift events. For example, the valve train assembly 10 may include four or more discrete lift events.

Described herein are systems and methods for an axial cam shifting valve train assembly having three or more discrete valve lift profiles unlike some known axial cam shifting systems, which have been limited to only two discrete positions and thus two discrete valve lift profiles. Such conventional two position systems allow a simple actuation and stop system that moves the axial shifting components into either front or rear positions between two mechanical stops. This greatly reduces the need for very precise component-to-component tolerance stack-ups as the axial position of the cam lobe to its mating component is defined by the mechanical stop and not the combined tolerances on all the components in the system.

Accordingly, the axial cam shifting valve train assembly described herein provides a third discrete valve lift profile by utilizing a deactivating lash adjuster. Thus, the assembly achieves more than two discrete valve lift profiles on an internal combustion engine while still utilizing an axial cam shifting system for some, but not all, discrete valve lift profiles. This is accomplished by incorporating one of the discrete valve lift profiles into another valvetrain device already on the engine (i.e., the lash adjuster).

Cylinder deactivation is a desired valve lift profile when the desired valve event is accomplished by not actuating an opening of the engine valves on particular cylinders. The assembly described herein utilizes a deactivating lash adjuster that can accomplish valve motion deactivation by collapsing to absorb or "lose" the motion of the cam lobe. Thus, the present disclosure enables an additional (third) discrete valve lift profile without having to add another position to the axial cam shifting system.

Figure 8:
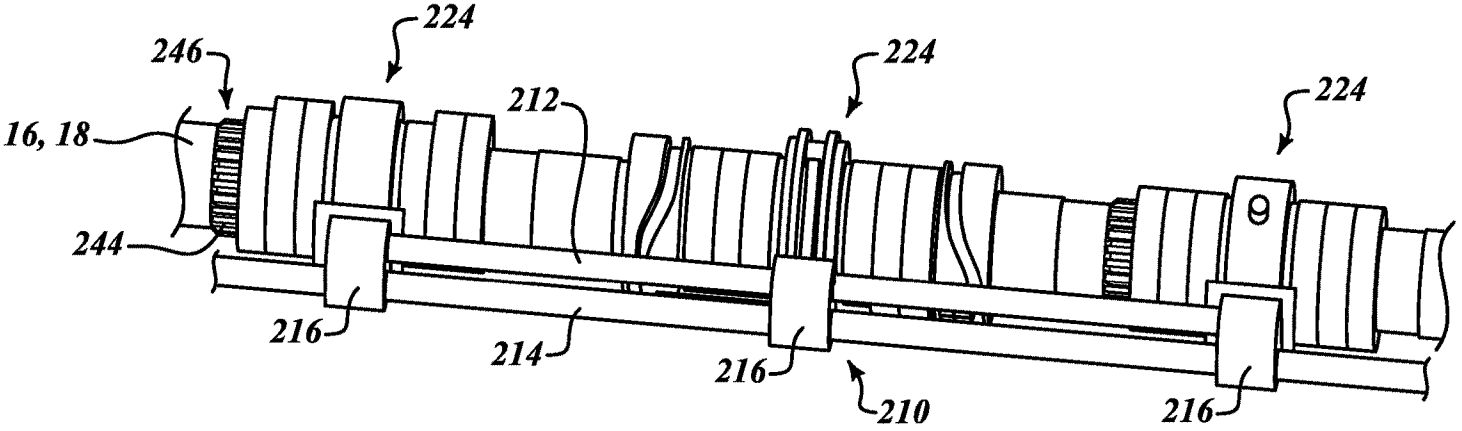
FIG. 8 is a perspective view of a partial valve train assembly incorporating a master-slave actuation system constructed in accordance with one example of the present disclosure.
Figure 9:
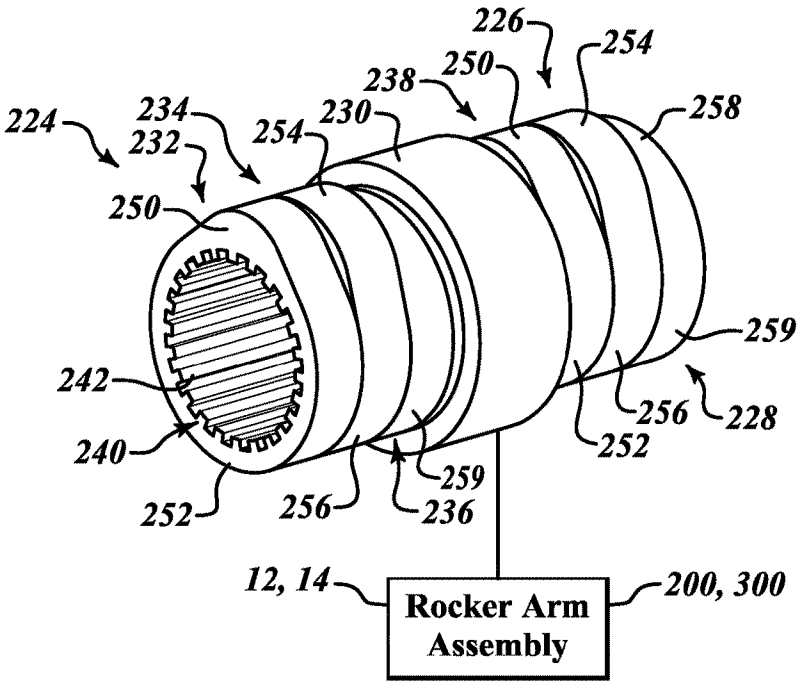
FIG. 9 is a perspective view of a cam assembly shown in FIG. 8 and associated rocker arm assembly constructed in accordance with one example of the present disclosure.

With reference to FIGS. 8 and 9, a cam assembly constructed in accordance with another example of the present disclosure is shown and generally identified at reference 224. The cam assembly 224 is similar to the cam assembly 24 described above, except cam assembly 224 is a three-lobed cam assembly, which provides three discrete valve lift profiles. Similar to the system described above, an additional (i.e., fourth) discrete valve lift profile is achieved utilizing the deactivating lash adjuster 26 with the three-lobed cam assembly 224. Thus, the present example enables an additional (fourth) discrete valve lift profile without having to add another position to the axial cam shifting system.

The cam assembly 224 can be arranged on camshaft 16 or 18 and is configured to selectively engage one of rocker arm assemblies 12, 14. The cam assembly 224 can be configured for an axial cam shifting operation where the cam assembly 224 can be moved axially along the camshaft 16, 18 between at least three discrete positions. As described herein, axial movement of the cam assembly 224 can control the opening height and/or timing of the cylinder valve 28 depending upon the axial position of the cam assembly 224.

FIG. 8 illustrates a master-slave actuation system 210 configured to switch the cam assembly between the three discrete positions. Actuation system 210 can generally include a first shifting rail 212, a second shifting rail 214, and a plurality of brackets 216. The first shifting rail 212 couples adjacent cam assemblies 224, and the brackets slidably couple the first shifting rail 212 to the second shifting rail 214. Actuators (not shown) can be positioned on the master to switch between the three profiles when the shifting rails 212, 214 are used to move the slave profiles relative to the master profiles.

With additional reference to FIG. 9, each cam assembly 224 can include a body 230, a first cam 232, a second cam 234, a third cam 236, a fourth cam 238, a fifth cam 226, and a sixth cam 228. The body 230 can be tubular and include in inner diameter or inner surface 240, which can be configured to receive the rotatable camshaft 16, 18. For example, the inner surface 240 may include a plurality of teeth 242 configured to meshingly engage teeth 244 formed on an outer surface 146 (FIG. 8) of the camshaft 16, 18.

As shown in FIG. 9, the first and fourth cams 232, 238 can have a first lobe or lift profile 250 and a base circle 252, the second and fifth cams 234, 226 can have a second lobe or lift profile 254 and a base circle 256, and the third and sixth cams 236, 228 can have a third lobe or lift profile 258 and a base circle 259. In the illustrated example, the first lift profiles 250 are angularly aligned and offset from both the second lift profiles 254 and the third lift profiles 258, which are respectively angularly aligned. Although each cam is illustrated as having a single lobe, each cam may have any suitable number of additional lobes to achieve separate or similar valve lift events. In one example, lobe 258 may be absent or sized to perform a cylinder deactivation instead of or in addition to lash adjuster 26.

The first lift profile 250 is configured to engage the rocker arm valve 20, 22 when the cam assembly 224 is in a first axial position, thereby achieving a first discrete valve lift event. The second lift profile 254 is configured to engage the rocker arm valve 20, 22 when the cam assembly 224 is in a second axial position, thereby achieving a second discrete valve lift event that can be distinct from the first valve lift event. The third lift profile 258 is configured to engage the rocker arm valve 20, 22 when the cam assembly 224 is in a third axial position, thereby achieving a third discrete valve lift event that can be distinct from both the first and second valve lift events.

For example, Table 1 below illustrates example camshaft profiles of actuation system 210 and cam assembly 224.

TABLE 1

| Cam Profiles | | | |
|---|---|---|---|
| Intake/Exhaust | Lobe 1 | Lobe 2 | Lobe 3 |
| Intake | Normal | LIVC-2 | LIVC-1 |
| Exhaust | Normal | Brake | EEVO |

The first lobe 250 can provide the normal intake and exhaust valve profiles. The second and third cam lobes 254, 258 on the intake can provide two different versions of Miller cycling using Late Intake Valve Closing (LIVC). The second lobe 254 on the exhaust can contain engine braking profiles, and the third lobe 258 on the exhaust can provide Early Exhaust Valve Opening (EEVO).

Moreover, the valve assemblies 12, 14 can achieve a fourth discrete valve event utilizing the lash adjuster 26, in a manner similar as described above. The lash adjuster 26 includes cylinder deactivation assembly 78, which includes an integrated lost motion function and is configured to provide the fourth discrete valve profile by selectively operating in a deactivated condition. Accordingly, the combination of the axial cam shifting (providing the first, second, and third discrete valve profiles) and the lash adjuster 26 (providing the fourth discrete valve profile) can provide an efficient valve train assembly 10 capable of providing four distinct valve profiles.

In the example implementation, the lash adjuster 26 can be selectively deactivated to introduce sufficient lost motion into the valve train 10 such that cyclical motion of the cam assembly 224 does not result in any corresponding opening and closing movement of the valve 28 for that particular cylinder. Accordingly, in this deactivated condition, the engine valve 28 remains closed under the influence of a valve closing spring 58 (see FIG. 2). The deactivating lash adjuster 26 can enable consistent valve profiles over the life of the engine since such devices can compensate for valve-train lash. As a result, the engine calibration can remain more stable over its life, the aftertreatment system can be optimized more tightly, and there may be no need for engine lash adjustment in service. Moreover, the lash adjuster 26 with integrated HLA can provide the additional benefit of improved valvetrain dynamics (stability), reduced engine noise, lower engine service costs (e.g., no need to adjust valve lash), and improved vehicle packaging by not having to design access to the valvetrain for lash adjustment.

In still further examples, valve train assembly 10 can provide additional discrete valve lift events by utilizing a deactivating rocker arm assembly 200 (FIG. 9) or a dual lift rocker arm assembly 300 (FIG. 9) instead of rocker arm assemblies 12, 14. Deactivating rocker arm assembly 200 can be a rocker arm that allows for selective activation and deactivation of the rocker arm, for example, as described in commonly owned U.S. Pat. No. 9,140,148, issued on Sep. 22, 2015, the contents of which are incorporated herein by reference. In one example, the axial cam shifting provides first, second, and third discrete valve profiles, and the deactivating rocker arm assembly 200 can provide a fourth discrete valve profile.

Dual lift rocker arm assembly 300 can be a rocker arm assembly providing more than one lift profile, for example, as described in commonly owned U.S. Pat. No. 8,752,513, issued Jun. 17, 2014, the contents of which are incorporated herein by reference. In one example, the axial cam shifting provides first, second, and third discrete valve profiles, and the dual lift rocker arm assembly 300 can provide a fourth discrete valve profile. In another example, the axial cam shifting can provide first and second discrete valve profiles, and the dual lift rocker arm assembly 300 can provide a third discrete valve profile. Moreover, the dual lift rocker arm assembly 300 may be activated between a first mode and a second mode hydraulically and/or electrically.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. A valve train assembly comprising:

a rocker arm assembly including a rocker arm with a first end and an opposite second end configured to engage an engine valve; and an axial shifting cam assembly movable between a first axial position and a second axial position on a camshaft, the cam assembly having a first cam having a first lobe, and a second cam having a second lobe, the first and second lobes configured to each selectively engage the rocker arm assembly to respectively perform a first and a second discrete valve lift event, wherein the rocker arm assembly is dual lift rocker arm assembly configured to perform a third discrete valve lift event, distinct from the first and second valve lift events, the dual lift rocker arm assembly configured for selective movement between a first mode and a second mode, at least one of the first and second modes providing the third discrete valve event, the dual lift rocker arm assembly comprising:

an outer arm;

an inner arm pivotably secured to the outer arm and having a latch bore;

a latch having a head, a body, and an orientation feature;

a sleeve; and an orientation plug extending through the sleeve into the orientation feature;

wherein the outer arm has a first end, a second end, and first and second outer side arms, wherein the inner arm is disposed between the first and second outer side arms and includes a first end, a second end, and a cam contacting surface disposed between the first and second ends, wherein the inner arm is pivotably secured adjacent its first end to the outer arm adjacent the first end of the outer arm, the inner arm having the latch bore adjacent its second end having a generally cylindrical wall and a bore wall, wherein the latch head has a first generally cylindrical diameter, the latch body has a second generally cylindrical diameter smaller than the first generally cylindrical diameter, the first and second cylindrical diameters extending along a common longitudinal axis, wherein the sleeve includes generally cylindrical inner and outer surfaces, the outer surface at least partially engaging the generally cylindrical wall of the latch bore, the inner surface at least partially engaging the body of the latch, wherein the latch moves along the longitudinal latch axis relative to the sleeve, the sleeve having an orientation plug aperture extending between generally cylindrical inner and outer surfaces, wherein the orientation plug extends along a longitudinal orientation plug axis that is transverse to the longitudinal latch axis, the orientation plug extending through the sleeve into the orientation feature, the orientation plug restricting rotation of the latch about the longitudinal latch axis.

* * * * *